United States Patent [19]

Williams

[11] 4,361,169

[45] Nov. 30, 1982

[54] PRESSURE COMPENSATED CONTROL VALVES

[75] Inventor: Arthur J. Williams, Youngstown, Ohio

[73] Assignee: Commercial Shearing, Inc., Youngstown, Ohio

[21] Appl. No.: 93,848

[22] Filed: Nov. 13, 1979

[51] Int. Cl.[3] ..... F15B 13/08

[52] U.S. Cl. ..... 137/596.13; 91/451

[58] Field of Search ..... 91/451, 518; 137/596.13

[56] References Cited

U.S. PATENT DOCUMENTS

| | | | |
|---|---|---|---|
| 3,592,216 | 7/1971 | McMillen | 91/518 X |
| 3,718,159 | 2/1973 | Tennis | 137/596.13 X |
| 3,777,773 | 12/1973 | Tolbert | 137/596.13 X |
| 3,815,477 | 6/1974 | Ailshie et al. | 137/596.13 X |
| 3,910,311 | 10/1975 | Wilke | 137/596.12 X |
| 3,970,108 | 7/1976 | Ailshie | 137/596.13 |
| 4,037,410 | 7/1977 | Jackson | 60/452 X |
| 4,061,159 | 12/1977 | Brakel | 137/596.13 X |

*Primary Examiner*—Gerald A. Michalsky

*Attorney, Agent, or Firm*—Buell, Blenko, Ziesenheim & Beck

[57] ABSTRACT

A multiple section control valve bank is provided having a control valve section and an inlet section operatively connected to provide smooth proportional metering control over a wide band of operating pressures while simultaneously metering the operation of two or more fluid actuated devices from a single fluid source. This is accomplished by providing metering and logic elements in the control valve section connected to a signal chamber in the inlet section to vary the flow of fluid through the inlet section to the control section in accordance with signals from the meter and logic elements.

30 Claims, 9 Drawing Figures

Fig. 4.
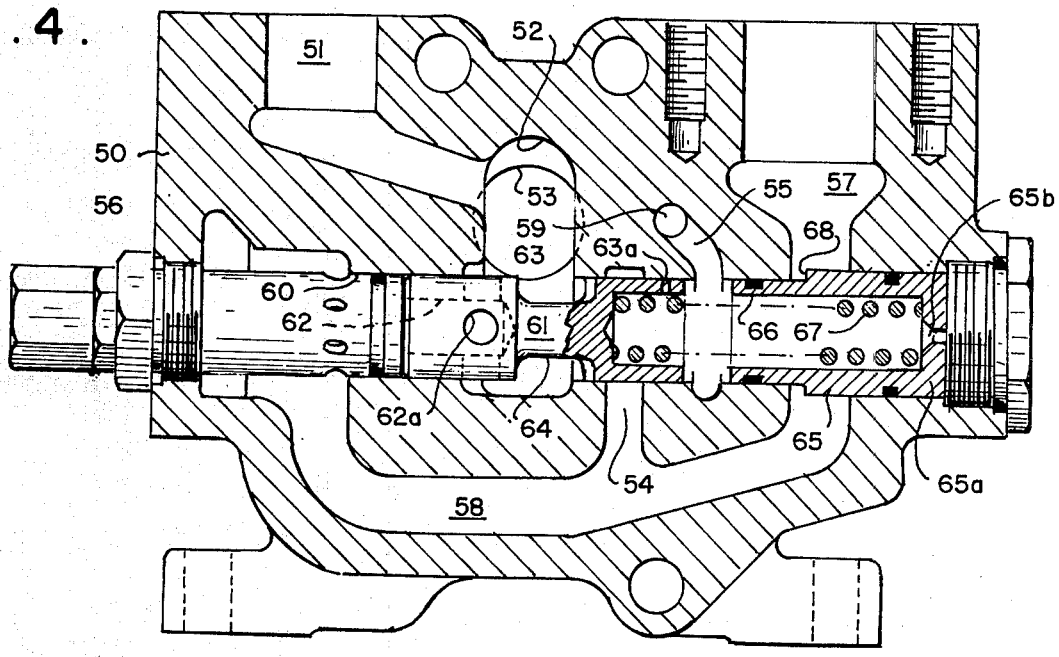
Fig. 6.
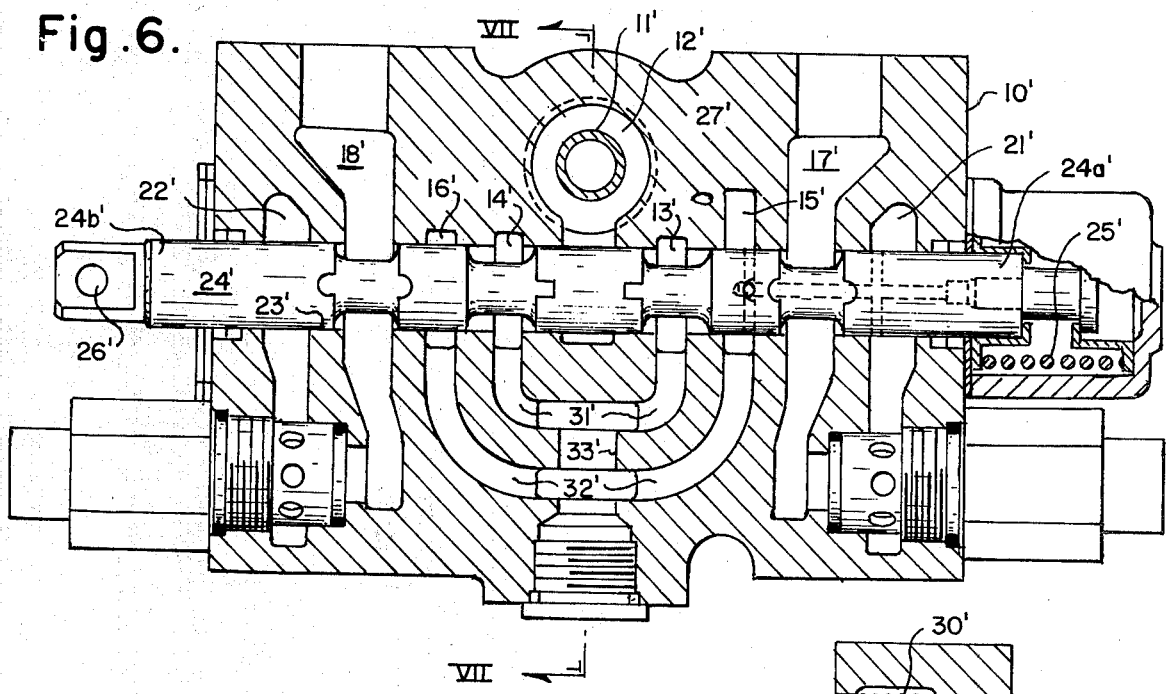
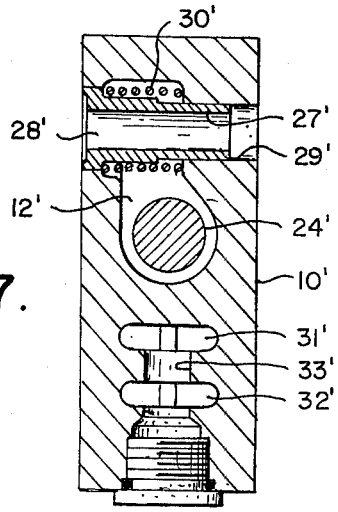
Fig. 7.

PRESSURE COMPENSATED CONTROL VALVES

This invention relates to pressure compensated control valves and particularly to a valve bank including a compensated pressure control valve section and an inlet section which is pressure compensating.

Control valves for use in mobil equipment such as backhoes, highlifts and the like have long been known and used. The trend has been over the years for constantly higher pressures coupled with a demand for smooth proportional metering control over a wide band of operating pressures. Simultaneous operation of two or more motors or cylinders from one pump, through one valve bank is another desired metering control function. While it would appear to be simple to split the available pump output between two or more motors or cylinders, it is in fact quite difficult and requires a special operator talent to properly split the flow and requires very precise and small valve spool adjustments, in the neighborhood of 1/32" or less, to avoid getting too much or too little volume to the required work operations.

I have invented a control valve bank including a working section and an inlet section which eliminates these problems. In this invention I provide a new concept in control valve bank assemblies in which the pump flow is metered at the inlet of each valve bank assembly and in which proportional flow and stroke changes are readily possible with little variations due to pressure. When simultaneous operations of more than one control valve working section is required, the operation is simple because proportional metering regulates the input volume to each work port at a generally uniform movement regardless of the pressure variations.

I provide in a multiple section control valve bank a valve working section and an inlet section that are operatively connected to provide smooth proportional metering control over a wide band of operating pressures and simultaneous metering operation of two or more fluid actuated devices from a single fluid pressure source, said control valve working section having a pressure inlet port, first and second work ports adapted to be connected to a fluid actuated device and spaced on opposite sides of the inlet port, first and second exhaust ports on opposite sides of said work ports from the inlet port, at least one pair of metering and logic ports with one port of said pair on each side of the inlet port between the inlet and the work ports, a bore extending through and interconnecting all of said ports, a valve element movable in said bore from a neutral position to first and second work positions for selectively connecting said ports and establishing fluid communication therebetween whereby in a work position fluid flows from the inlet port through said at least one pair of metering and logic ports to one of said work ports, said inlet section having an inlet port adapted to be connected to a source of fluid pressure, an outlet port connected to a valve section inlet port and in continuous communication with said inlet port of the inlet section, an exhaust port, a spaced by-pass port connected to said exhaust port, a signal port between said exhaust port and by-pass port, a bore extending through and connecting said ports in said inlet section, a valve member movable in said bore between said signal port and by-pass port effective to control fluid communicating from the inlet to the outlet port of the inlet section and being movable to a by-pass position by-passing fluid from the inlet through the by-pass port to said exhaust port, biasing means opposing the movement of said valve member to said by-pass position, a connection between said outlet port of said inlet section and said inlet port of said control valve section delivering fluid therebetween, logic means connecting the signal port of said inlet section and a logic port of said control valve whereby the pressure in said signal port is varied in accordance with the difference between the pressure in the inlet port of the inlet section and the fluid pressure at said logic port to vary the biasing means opposing movement of said inlet section valve member whereby the flow of fluid from the inlet port to the outlet port of the inlet section is varied. Preferably the inlet section includes piston means in the inlet section bore positioned for limited movement, means communicating through the piston from the signal port to the bore whereby pressure variations in said signal port causes said piston to move in the bore to vary the biasing means. The biasing means preferably includes resilient means between the piston and valve member in the inlet section bore normally urged them apart. Preferably at least one pair of metering and logic ports in the working section are connected together and to the inlet port by a bore spaced from and generally alongside the main bore. A pressure compensated flow control valve is preferably placed between the pair of metering and logic ports and the inlet port. A parallel flow transition check valve, such as a hollow cylindrical spring-loaded sleeve, which closes the connection from the inlet port to the metering and logic ports and by-passes fluid to the next succeeding valve or divides the flow of fluid between the inlet port and the next succeeding valve is provided in the inlet port of the working section. The logic means preferably includes a fluid actuated valve means in the working section having two control inlet ports, one communicating with the outlet and the other to the logic port of the working section and a control signal outlet port connected to the signal port of said inlet section. Preferably, I provide a pair of metering ports and a separate pair of logic ports between the metering ports and the work ports, each pair connected together by U-shaped passages, and the two U-shaped passages connected to the inlet port through a pressure compensated flow control valve.

In the foregoing general description of my invention I have set out certain objects, purposes and advantages of the invention. Other objects, purposes and advantages will be apparent from a consideration of the following description and the accompanying drawings in which:

FIG. 4 is a longitudinal section through an inlet section according to this invention.

FIG. 6 is a longitudinal section of a second embodiment of control working valve section according to this invention;

FIG. 7 is a section on the line VII—VII of FIG. 6;

Figure 1:
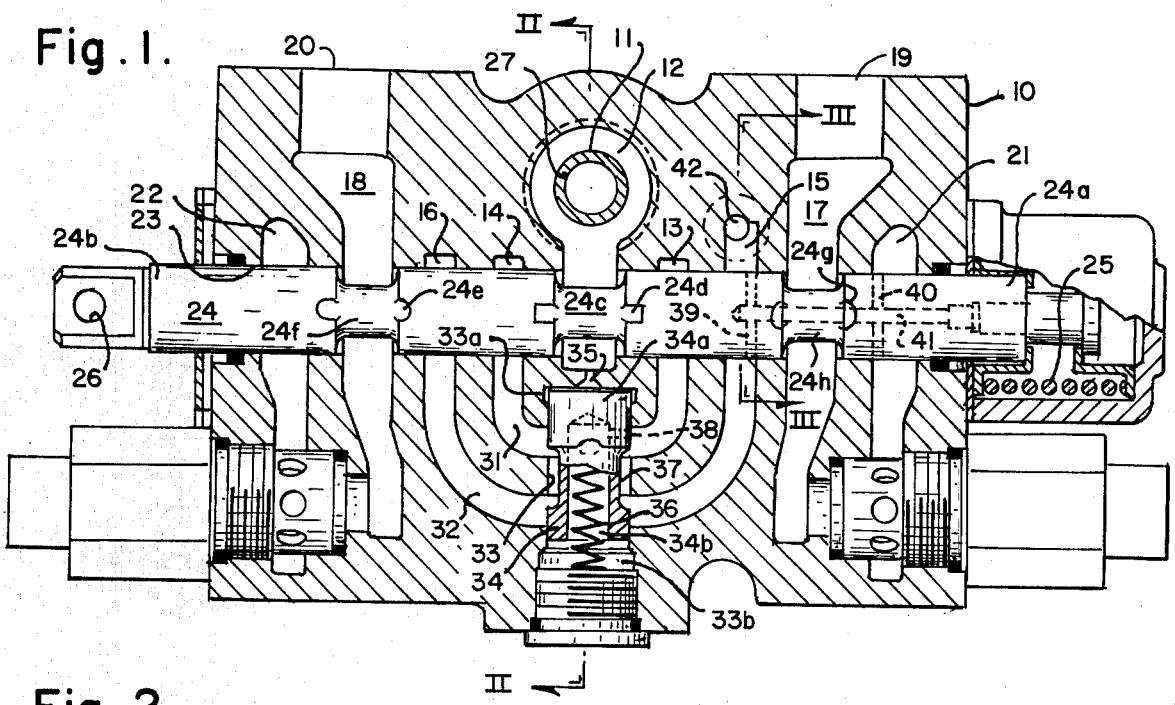
FIG. 1 is a longitudinal section through a control valve section according to this invention.

Referring to the drawings I have illustrated a control valve working section according to my invention in FIG. 1 having a housing 10 with an inlet port 11, an inlet chamber 12, a pair of metering chambers 13 and 14 on opposite sides of the inlet chamber, a pair of logic chambers 15 and 16 on opposite sides of the metering chambers 13 and 14, a pair of work chambers 17 and 18 with work ports 19 and 20 on opposite sides of the logic chambers 15 and 16 and finally a pair of exhaust chambers 21 and 22 on opposite sides of the work chambers 17 and 18. An elongate bore 23 extends through housing 10 intersecting all of chambers 12–18, 21 and 22. Valve member or spool 24 extends through bore 23 and out of the housing 10 at both ends. One end 24*a* is provided with a conventional centering mechanism 25. The other end 24*b* is provided with an eye 26 for a hand control lever (not shown) of conventional design. The inlet port 11 is provided with a cylindrical sleeve check valve 27 having a central passage 28 which communicates with an outlet port 29 to provide a parallel passage for fluid flow to the next succeeding valve in a valve bank. The check valve 27 is normally urged to the closed position by a spring 30. The two metering chambers 13 and 14 are connected by a U-shaped passage 31 and the two logic chambers 15 and 16 are connected by a similar generally parallel U-shaped passage 32. Passages 31 and 32 are intersected intermediate their ends by a transverse passage 33 carrying a pressure compensated flow control spool 34. Passage 33 terminates short of inlet chamber 12 with a head chamber 33*a* which communicates with inlet chamber 12 by way of a passage 35. One end 34*a* of spool 34 is urged against the end of chamber 33*a* by a spring 36. The other end of spool 34 is hollow and has an axial bore 34*b* which carries spring 36 and is open to a chamber 33*b* at the end of passage 33 opposite chamber 33*a*. Spool 34 is provided with an external annular groove 37 intermediate its ends. A side passage 38 extends through the wall of spool 34 to provide constant communication between bore 34*b* and metering passage 31. Spool 24 is provided with spaced apart transverse passages 39 and 40 which intersect axial passage 41 to connect logic passage 32 with exhaust port 21 when spool 34 is in the neutral position. In all other positions communication is shut off by the adjacent lands of the housing. Logic chamber 15 connects to a fluid actuated valve passage 42 having valve seats 43 and 44 at each end and an intermediate movable check member 45 such as a ball which can move from one seat to the other dependent upon pressure flow. An intermediate outlet port 46 connects to a by-pass line 47 which connects with a like passage 42 in the next adjacent valve through seat 43.

I also provide an inlet section having a housing 50 with an inlet port 51 connected to an outlet chamber 52 and an outlet port 53 connected to the same outlet chamber. A by-pass chamber 54 is spaced from said outlet chamber 52 along with a signal chamber 55 on the opposite side of said by-pass chamber 54 from the outlet chamber. A pair of exhaust chambers 56 and 57 are placed on opposite sides of all of the chambers and are connected together by a passage 58 which also intersects by-pass chamber 54. Signal passage 55 has a signal port 59 which connects with passage 47 of the working valve section 10. A bore 60 extends lengthwise of housing 50 through all of chambers 52, 54, 55, 56 and 57 and carries, intermediate its ends, a valve spool 61 which has axial bores 62 and 63 at its opposite ends and an annular groove 64 intermediate its ends. A transverse passage 62*a* through the wall of spool 61 provides communication from outlet chamber 52 into axial bore 62. A piston 65 is movable in the end of bore 60 adjacent bore 63 and is provided with an axial bore 66 which is open at the end adjacent bore 63 and carries spring 67 which extends into bore 63 and urges the piston 65 and spool 61 apart. The bore 66 terminates short of the end of piston 65 leaving a head 65*a* which has an opening 65*b* therethrough into the end of bore 60. Piston 65 has a shoulder 68 which limits its movement toward signal chamber 55 so that it cannot close chamber 55. Spool 61 has a transverse passage 63*a* through its wall into bore 63 which is normally closed by the wall of bore 60 but when spool 61 is moved to the left against spring 67 it opens to signal chamber 55.

Figure 2:
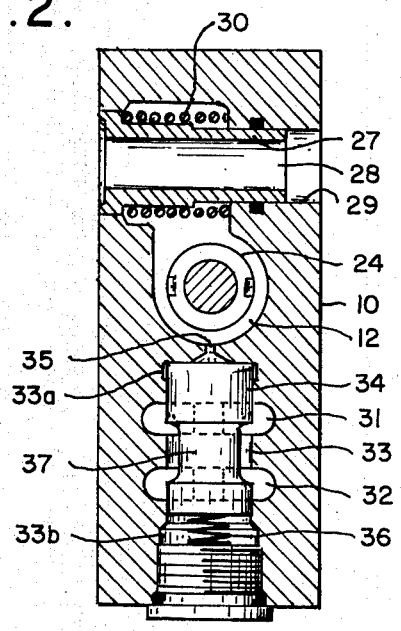
FIG. 2 is a section on the line II—II of FIG. 1.
Figure 5:
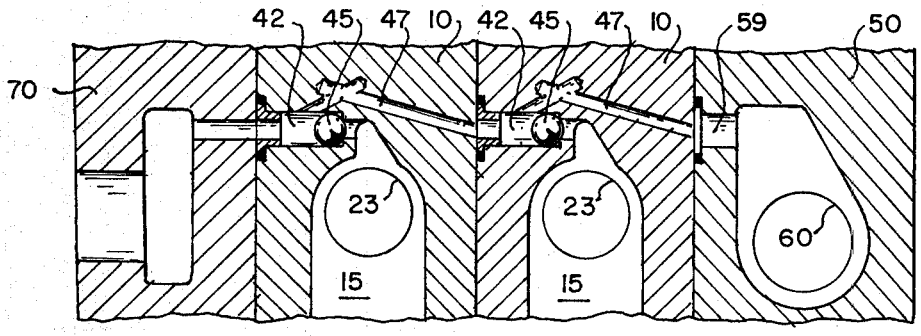
FIG. 5 is a transverse section through a bank of control valves according to this invention including an inlet section of this invention and an outlet section.

In operation inlet section housing 50 is assembled with one or more working section housings 10 and an outlet section 70 as illustrated in FIG. 5. So assembled, outlet port 53 of the inlet section 30 is aligned with inlet port 11 of working section 10 so that fluid entering inlet port 51 passes through chamber 52; through outlet port 53 to inlet port 11 where it moves sleeve check 27 to the right, viewing FIG. 2, to divide the fluid into chamber 12 and through axial passage 28 into the inlet port 11 of the next succeeding valve. Fluid in chamber 12 passes through passage 35 into chamber 33*a* pressurizing the end of valve 34 to urge it downwardly against spring 36. When the spool 24 is moved to a working position, as for example to the right in FIG. 1, fluid in chamber 12 follows annular groove 24*c* and flows first through metering slots 24*d* into passage 31, through passage 38 into the interior bore 34*b* of valve 34 where it counteracts the effect of the fluid in chamber 33*a* so that spring 36 holds the valve 34 in the position shown in FIG. 1. This permits fluid to pass around groove 37 into logic passage 32 where it passes first through metering slots 24*e* around groove 24*f* into work chamber 18. On the other end of spool 24 metering slots 24*g* and groove 24*h* return fluid from a motor (not shown) to exhaust chamber 21 from work port 19 and chamber 17. At the same time fluid flows through valve seat 44 to force check ball 45 to the left (viewing FIGS. 3 and 5) and out passage 47 to inlet 59 and signal chamber 55 of inlet section 50 where it pressurizes bores 63 and 66 and passes through passage 65*b* to urge piston 65 leftward, viewing FIG. 4, to hold valve spool 61 in the position shown in FIG. 4 to prevent by-passing any fluid through chamber 54.

As spool 24 is moved right, the groove 24*c* connects chamber 12 with chamber 13 to the maximum as does groove 24*f* also connect chambers 18 and 16, permitting maximum flow to work port 20. The length and size of metering grooves 24*d* control the input to either work port by telling the flow control spool 34 to permit proportional flow input changes at a constant predetermined pressure differential on the spool end chambers 33*a* and 33*b*. In the neutral position logic passage 32 is vented to exhaust chamber 21 through transverse passages 39 and 40 and axial passage 41. The vent passages are arranged so that a very small movement of spool 24 to the right or left will close passage 39 or 40 and thus terminate venting of logic passage 32 to exhaust chamber 21. If the spool 24 of another work section 10 in the valve bank is actuated to feed another motor operating at a lower pressure, then check valve 27 of the higher pressure valve will close to prevent back flow from the work port of the higher pressure function valve. In short, the valve 27 is a sleeve unbalanced to close under the pressure of spring 30 if the pressure in chamber 12 is greater than the pressure at the inlet port 11 and parallel bore 28.

When the pressure in metering passage 31 drops below the pressure in chamber 12, the compensated flow control spool 34 moves downwardly, view FIG. 1, due to pressure in chamber 33*a* choking off the passage of fluid around annular groove 37 between metering passage 31 and logic passage 32.

Figure 3:
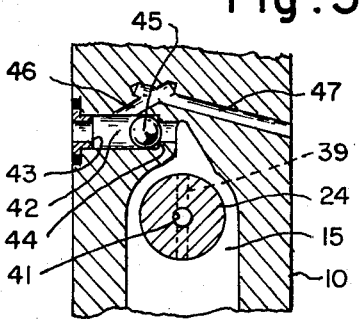
FIG. 3 is a fragmentary section on the line III—III of FIG. 1.

Similarly if the pressure in logic passage 32 of any spool drops below the pressure in any spool in the system the ball check 45 of that valve moves to the right, viewing FIGS. 3 and 5, permitting flow through port 43, through output port 46 and passage 47 to signal chamber 55 of the input section. If the pressure in logic passage 32 of all of the valves in the bank drops below the input pressure, then the pressure in signal chamber 55 drops and spool 61 moves to the right, viewing FIG. 4, by-passing input fluid from chamber 52 around groove 64, through bore 60 into by-pass chamber 54 and from thence to exhaust chamber 57.

In FIGS. 6 and 7 we have illustrated an identical valve structure as in FIGS. 1 through 5 except for the omission of the pressure compensated flow control spool 34, its associated pressure chambers 33*a* and 33*b* and spring 36. All like parts are identified by like numbers with a prime sign. The operation of this second embodiment is precisely the same as the first embodiment of FIGS. 1–5 except for the omission of the function of the pressure compensated flow valve 34.

Figure 8:
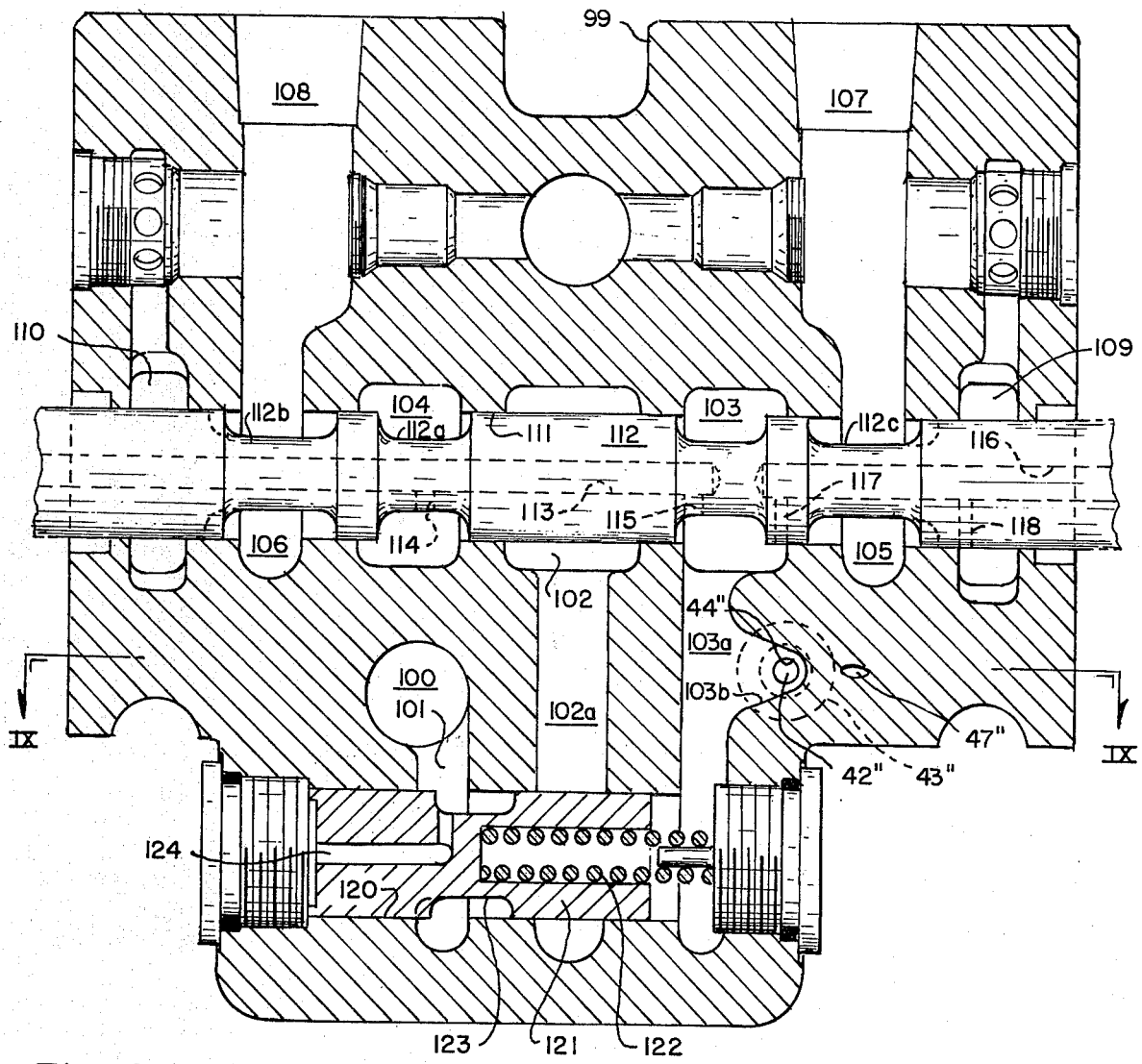
FIG. 8 is a longitudinal section of a third embodiment of control working valve section according to this invention.
Figure 9:
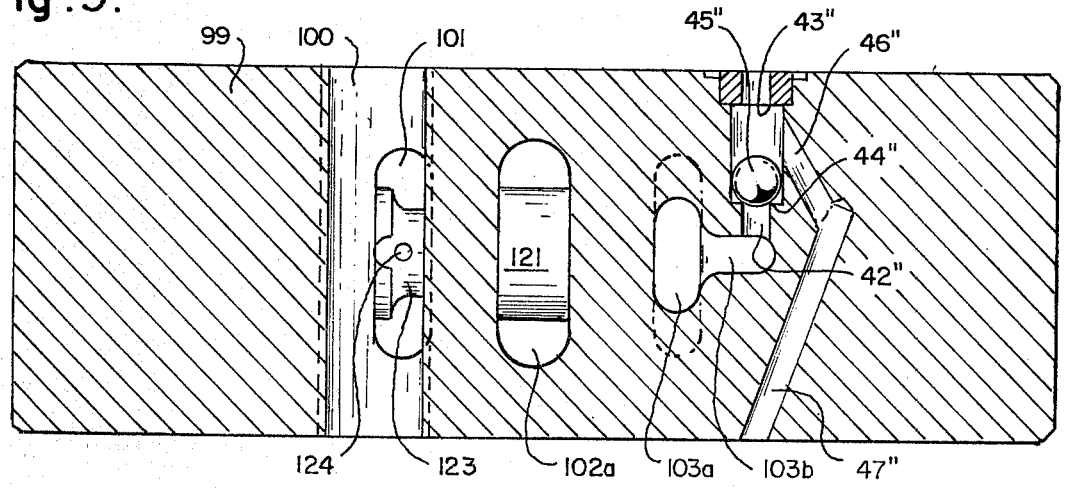
FIG. 9 is a section on the line IX—IX of FIG. 8.

In FIGS. 8 and 9 I have illustrated a third modification of working section having a housing 99, an inlet port 100, an inlet chamber 101, a metering chamber 102, a pair of logic chambers 103 and 104, two work chambers 105 and 106 with work ports 107 and 108 and a pair of exhaust chambers 109 and 110. A longitudinal bore 111 extends lengthwise of housing 99 through chambers 102 through 106 and 109 and 110. A spool 112 is movable lengthwise in bore 111. Spool 112 is provided with an axial logic passage 113 and transverse passages 114 and 115 which connect logic chambers 103 and 104 in all positions of spool 112. Spool 112 is also provided with a second spaced axial bore 116 and transverse passage 117 and 118 which connect logic chamber 103 and exhaust chamber 109 when spool 112 is in the neutral position precisely as does passages 39, 40 and 41 of FIG. 1 for the same purpose and function.

Chambers 102 and 103 have elongated portions 102*a* and 103*a* which intersect a second bore 120 spaced from and parallel to bore 111. Bore 120 also intersects inlet chamber 101. A valve spool 121 is movable in bore 120 but is normally urged to the left, viewing FIG. 8, by spring 122 to prevent flow from inlet chamber 101 to metering chamber 102*a*. Spool 120 has an annular groove 123 intermediate its ends and a biasing passage 124 from groove 123 to the end of spool 120 remote from spring 122. Logic chamber 103*a* has a side arm portion 103*b* which connects to a fluid actuated valve passage 42″ with valves seats 43″ and 44″ and by-pass line 47″ whose function and structure are precisely like the same number, less the prime sign, parts of FIG. 1. Passage 47 connects to signal chamber 55 of inlet section 50 as in FIGS. 1–4.

In operation fluid under pressure from a pump, not shown, passes through inlet section 50 and from outlet port 53 to inlet port 100 of the valve of FIG. 8. Fluid under pressure entering inlet port 100 goes to chamber 101 where it passes through passage 123 into bore 120 at the end of spool 121, and pressurizes spool 121 to move it to the right, viewing FIG. 8. This permits the pressure fluid to flow around groove 123 from inlet chamber 101 through bore 120 to metering chamber extension 120*a* so long as the pressure in chamber 101 is sufficient to pressurize the end of spool 121 to overcome spring 122. The position of spool 121 will vary with the pressure on its end and thus provides pressure compensation on the individual valve. If the spool 112 is now moved from the neutral position shown in FIG. 8 to either the right or left to a work position, fluid will flow from the metering chamber 102 through one of the logic chambers to a work chamber and port. Assuming, for example, that the spool 112 is moved to the right, viewing FIG. 8, pressure fluid will flow from metering chamber 102 around annular groove 112*a* to logic chamber 104, then around groove 112*b* through bore 111 to chamber 106 and out work port 108. At the same time pressure fluid in logic chamber 104 passes through transverse passages 114 and 115 and axial passage 113 to logic chamber 103 so that chambers 104 and 103 have the same pressure. This pressure is transmitted through logic chamber extension 103*a*, side arm 103*b* to port 42″ to signal chamber 55 of the inlet section 50. At the same time return fluid from the motor which is pressurized from port 108 returns through work port 107, chamber 105 around annular groove 112*c* through bore 111 into exhaust chamber 109.

In the foregoing specification I have set out certain preferred embodiments and practices of my invention, however, it will be understood that this invention may be otherwise practiced within the scope of the following claims.

I claim:

1. In a multiple section control valve bank a control valve working section and an inlet section and an outlet section on opposite sides of said working section that are operatively connected to provide smooth proportional metering control over a wide band of operating pressures and simultaneous metering operation of two or more fluid actuated devices from a single fluid pressure source, said control valve working section having a pressure fluid inlet port on one side of said section, an inlet chamber connected to said inlet port, an outlet port on the opposite side of said section connected with said inlet port and chamber, first and second work ports adapted to be connected to a fluid actuated device, first and second work chambers connected to said ports and spaced on opposite sides of said inlet chamber, first and second exhaust chambers on opposite sides of said work chambers from the inlet chamber, at least one metering chamber between said work chambers, a pair of logic chambers with one chamber on each side of the at least one metering chamber between the at least one metering chamber and the work chambers, a main bore 23 extending through and interconnecting at least all of said exhaust, work, logic and metering chambers, a valve element movable in said bore from a neutral position to first and second work positions for selectively connecting said chambers through said bore and establishing fluid communication therebetween whereby in a work position fluid flows from the inlet port through said inlet chamber to said at least one metering chamber and then through at least one of said logic chambers to one of said work ports, said inlet section having an inlet port adapted to be connected to a source of fluid pressure, an outlet port and chamber connected to said inlet port and to a valve section inlet port at all times, an exhaust port, a spaced by-pass chamber connected to said exhaust port, and a signal chamber between said exhaust port and by-pass chamber, a bore extending through and connecting said chambers in said inlet section, a valve member movable in said bore between said signal chamber and said by-pass chamber effective to control fluid communicating from the inlet to the outlet port and being movable to a by-pass position by-passing fluid from the inlet through the by-pass chamber to said exhaust port, biasing means opposing the movement of said valve member to said by-pass position, a connection between said outlet port of said inlet section and said inlet port of said control valve section delivering fluid therebetween, logic means connecting the signal chamber of said inlet section and a logic chamber of said control valve whereby the pressure in said signal chamber is varied in accordance with the difference between the pressure in the inlet port of the inlet section and the fluid pressure at said logic chamber to vary the biasing means opposing movement of said inlet section valve member whereby the flow of fluid from the inlet port to the outlet port of the inlet section is varied by by-passing fluid.

2. A control valve bank section including a working section and inlet section as claimed in claim 1 wherein the inlet section includes piston means in said bore positioned for limited movement therein, means communicating through said piston from said signal chamber to said bore whereby pressure variations in said signal chamber causes said piston to move in the bore to vary the biasing means.

3. A control valve bank as claimed in claim 2 wherein the biasing means includes resilient means between said piston and valve member normally urging them apart.

4. A control valve bank as claimed in claim 1 or 2 or 3 wherein the metering and logic chambers in the working section are connected together and to the inlet chamber by a bore spaced from and generally alongside the main bore.

5. A control valve bank as claimed in claim 4 wherein the metering and logic chambers are connected to the inlet chamber through a pressure compensated flow control valve.

6. A control valve bank as claimed in claim 4 wherein the inlet port of the work section includes a parallel flow transition check valve which closes the connection from the input port to the metering and logic chambers in the event that pressure in the inlet port drops below that of the logic and metering chambers when the valve is in a work position.

7. A control bank as claimed in claim 6 wherein the parallel transition check valve is a hollow cylindrical spring-loaded sleeve in the inlet port which in the closed position by-passes fluid through the inlet port to a next section of the bank and in the open position divides the flow of fluid between the inlet chamber of the working section and a next section of the bank.

8. A control valve bank as claimed in claim 4 wherein the valve element in the working section has a generally axial passage connecting transverse passage communicating through the valve element wall with at least one logic chamber and an exhaust port in the neutral position.

9. A control valve bank as claimed in claim 4 wherein the valve element in the working section has a reduced diameter at each of the inlet and working ports and metering slots of pre-selected length extending on the surface thereof in each direction from each said reduced diameter portion.

10. A control valve bank as claimed in claim 1 or 2 or 3 wherein the logic means includes a fluid actuated valve means in the working section having two control signal inlet ports, one connected to the outlet section and the other to a logic port, and a control signal outlet port intermediate the inlet ports connected to the signal port of said inlet section.

11. A control bank as claimed in claim 10 wherein the fluid actuated valve means is a three-port shuttle valve.

12. A control valve bank as claimed in claim 1 or 2 or 3 wherein the working section includes a pair of metering chambers and a pair of logic chambers between the metering chambers and the work chambers.

13. A control valve bank as claimed in claim 12 wherein the metering and logic chambers are connected together and to the inlet chamber by a common passage.

14. The control valve bank as claimed in claim 12 wherein the logic and metering chambers are connected together and to the inlet chamber by a common passage having a pressure compensated flow control valve between said metering and logic chambers and the inlet chamber.

15. A control valve bank as claimed in claim 14 wherein the valve element in the working section has a generally axial passage connecting transverse passage communicating through the valve element wall with at least one logic chamber and an exhaust port in the neutral position.

16. A control valve bank as claimed in claim 14 wherein the valve element in the working section has a reduced diameter at each of the inlet and working ports and metering slots of pre-selected length extending on the surface thereof in each direction from each said reduced diameter portion.

17. A control valve bank as claimed in claim 12 wherein the valve element in the working section has a generally axial passage connecting transverse passage communicating through the valve element wall with at least one logic chamber and an exhaust port in the neutral position.

18. A control valve bank as claimed in claim 12 wherein the valve element in the working section has a reduced diameter at each of the inlet and working ports and metering slots of pre-selected length extending on the surface thereof in each direction from each said reduced diameter portion.

19. A control valve bank as claimed in claim 1 or 2 or 3 wherein the valve element in the working section has a generally axial passage connecting transverse passage communicating through the valve element wall with at least one logic chamber and an exhaust port in the neutral position.

20. A control valve bank as claimed in claim 1 or 2 or 3 wherein the valve element in the working section has a reduced diameter at each of the inlet and working ports and metering slots of pre-selected length extending on the surface thereof in each direction from each said reduced diameter portion.

21. In a multiple section control valve bank a control valve working section, an inlet section and an outlet section that are operatively connected to provide smooth proportional metering control over a wide band of operating pressures and simultaneous metering operation of two or more fluid actuated devices from a single fluid pressure source, said control valve working section having a pressure fluid inlet port on one side of said section, an inlet chamber connected to said inlet port, an outlet port on the opposite side of said section connected with said inlet port and chamber, first and second work ports adapted to be connected to a fluid actuated device first and second work chambers connected to said ports and spaced on opposite sides of said inlet chamber, first and second exhaust chambers on opposite sides of said work chambers from the inlet chambers, a pair of metering chambers between said work chambers, a pair of logic chambers with one chamber on each side of the pair of metering chambers between the pair of metering chambers and the work chambers, a main bore extending through and interconnecting at least all of said exhaust, work, logic and metering chambers, a valve element movable in said bore from a neutral position to first and second work positions for selectively connecting said chambers through said bore and establishing fluid communication therebetween whereby in a work position fluid flows from the inlet port through said inlet chamber to said pair of metering chambers and then through at least one of said logic chambers to one of said work ports, said inlet section having an inlet port adapted to be connected to a source of fluid pressure, an outlet port and chamber connected to said inlet port and to a valve section inlet port at all times, an exhaust port, a spaced by-pass chamber connected to said exhaust port, a signal chamber between said exhaust port and by-pass chamber, a bore extending through and connecting said chambers in said inlet section, a valve member movable in said bore between said signal chamber and said by-pass chamber effective to control fluid communicating from the inlet to the outlet port and being movable to a by-pass position by-passing fluid from the inlet through the by-pass chamber to said exhaust port, biasing means opposing the movement of said valve member to said by-pass position, a connection between said oulet port of said inlet section and said inlet port of said control valve section delivering fluid therebetween, logic means connecting the signal chamber of said inlet section and a logic chamber of said control valve whereby the pressure in said signal chamber is varied in accordance with the difference between the pressure in the inlet port of the inlet section and the fluid pressure at said logic chamber to vary the biasing means opposing movement of said inlet section valve member whereby the flow of fluid from the inlet port to the outlet port of the inlet section is varied by by-passing fluid, wherein the metering chambers are connected together by a generally U-shaped passage, the logic chambers are connected together by a similar generally parallel U-shaped passage and the two U-shaped passages intersect a passage generally transverse to the main bore connected to said inlet chamber.

22. A control valve bank section including a working section and inlet section as claimed in claim 21 wherein the inlet section includes piston means in said bore positioned for limited movement therein, means communicating through said piston from said signal chamber to said bore whereby pressure variations in said signal chamber causes said piston to move in the bore to vary the biasing means.

23. A control valve bank as claimed in claim 22 wherein the biasing means includes resilient means between said piston and valve member normally urging them apart.

24. A control valve bank as claimed in claim 13 or 22 or 23 having a pressure compensated flow control valve in said transverse passage between the two U-shaped passages and the inlet chamber.

25. A control valve bank as claimed in claim 24 wherein the inlet port of the work section includes a parallel flow transition check valve which closes the connection from the input port to the metering and logic chambers in the event that pressure in the inlet port drops below that of the logic chambers when the valve is in a work position.

26. A control valve bank as claimed in claim 25 wherein the parallel transition check valve is a hollow cylindrical spring-loaded sleeve in the inlet port which in the closed position by-passes fluid through the inlet port to a next section of the bank and in the open position divides the flow of fluid between the inlet chamber of the working section and a next section of the bank.

27. A control valve bank as claimed in claim 24 wherein the logic means includes a fluid actuated valve means in the working section having two control signal inlet ports, one connected to the outlet section and the other to a logic port and a control signal outlet port intermediate the inlet ports connected to the signal port of said inlet section.

28. A control valve bank as claimed in claim 13 or 22 or 23 wherein the inlet port of the work section includes a parallel flow transition check valve which closes the connection from the input port to the metering and logic chambers in the event that pressure in the inlet port drops below that of the logic chambers when the valve is in a work position.

29. A control valve bank as claimed in claim 28 or 22 wherein the parallel transition check valve is a hollow cylindrical spring-loaded sleeve in the inlet port which in the closed position by-passes fluid through the inlet port to a next section of the bank and in the open position divides the flow of fluid between the inlet chamber of the working section and a next section of the bank.

30. A control valve bank as claimed in claim 13 or 22 or 23 wherein the logic means includes a fluid actuated valve means in the working section having two control signal inlet ports, one connected to the outlet section and the other to a logic port and a control signal outlet port intermediate the inlet ports connected to the signal port of said inlet section.

* * * * *

UNITED STATES PATENT AND TRADEMARK OFFICE

CERTIFICATE OF CORRECTION

PATENT NO. : 4,361,169
DATED : November 30, 1982
INVENTOR(S) : ARTHUR J. WILLIAMS It is certified that error appears in the above-identified patent and that said Letters Patent are hereby corrected as shown below:

Column 2, line 22, "urged" should read --urging--.

Column 2, line 58, "FIG. 5" should start a new paragraph.

Column 6, line 5, "120a" should read --102a--.

Claim 24, column 10, line 10, "13" should be --21--.

Claim 28, column 10, line 35, "13" should be --21--.

Claim 29, column 10, line 43, should read --as claimed in claim 28 or 22 or 23--.

Claim 30, column 10, line 50, "13" should be --21--.

Signed and Sealed this

*Nineteenth* Day of *July 1983*

[SEAL]

*Attest:*

GERALD J. MOSSINGHOFF

*Attesting Officer*

*Commissioner of Patents and Trademarks*